United States Patent [19]

Thota et al.

[11] Patent Number: 5,053,594

[45] Date of Patent: Oct. 1, 1991

[54] COOK AND SERVE FOOD PACKAGE FOR THE STORING AND HEATING BY MICROWAVE ENERGY OF A FOOD ITEM

[75] Inventors: Hamsa A. P. Thota; Shankara R. Shetty, both of St. Simons Island, Ga.

[73] Assignee: Rich-Seapak Processing Corporation, St. Simons Island, Ga.

[21] Appl. No.: 433,945

[22] Filed: Nov. 9, 1989

[51] Int. Cl.[5] ..... H05B 6/80

[52] U.S. Cl. ..... 219/10.55 E; 219/10.55 F; 426/107; 426/118; 426/234; 426/243; 99/DIG. 14

[58] Field of Search ..... 219/10.55 E, 10.55 F, 219/10.55 R, 10.55 M; 426/107, 113, 114, 118, 241, 243, 234; 99/DIG. 14

[56] References Cited

U.S. PATENT DOCUMENTS

| | | | |
|---|---|---|---|
| 4,184,061 | 1/1980 | Suzuki et al. | 219/10.55 E |
| 4,190,757 | 2/1980 | Turpin et al. | 219/10.55 E |
| 4,210,674 | 7/1980 | Mitchell | 426/107 |
| 4,230,924 | 10/1980 | Brastad et al. | 219/10.55 E |
| 4,267,420 | 5/1981 | Brastad | 219/10.55 E |
| 4,419,373 | 12/1983 | Oppermann | 426/234 |
| 4,496,815 | 1/1985 | Jorgensen | 219/10.55 E |
| 4,497,431 | 2/1985 | Fay | 219/10.55 E |
| 4,542,271 | 9/1985 | Tanonis et al. | 219/10.55 E |
| 4,590,349 | 5/1986 | Browa et al. | 219/10.55 E |
| 4,592,914 | 6/1986 | Kuchenbecker | 426/107 |
| 4,594,492 | 6/1986 | Maroszck | 219/10.55 E |
| 4,612,431 | 9/1986 | Brown et al. | 219/10.55 E |
| 4,640,838 | 2/1987 | Isakson et al. | 426/107 |
| 4,641,005 | 2/1987 | Seiferth | 219/10.55 E |
| 4,701,585 | 10/1987 | Stewart | 219/10.55 E |
| 4,703,148 | 10/1987 | Mikulski et al. | 219/10.55 E |
| 4,713,510 | 12/1987 | Quick et al. | 219/10.55 E |
| 4,742,203 | 5/1988 | Brown et al. | 219/10.55 E |
| 4,745,249 | 5/1988 | Daniels | 219/10.55 E |
| 4,751,358 | 6/1988 | Durand | 219/10.55 E |
| 4,775,771 | 10/1988 | Pawlowski | 219/10.55 E |
| 4,777,053 | 10/1988 | Tobelmann et al. | 426/107 |
| 4,785,160 | 11/1988 | Hart | 219/10.55 E |
| 4,794,005 | 12/1988 | Swiontek | 426/107 |
| 4,825,025 | 4/1989 | Seiferth | 219/10.55 E |
| 4,835,352 | 5/1989 | Sasaki et al. | 219/10.55 E |
| 4,861,957 | 8/1989 | Welles | 219/10.55 E |
| 4,865,921 | 9/1989 | Hollenberg et al. | 219/10.55 E X |
| 4,883,936 | 11/1989 | Maynard et al. | 219/10.55 F |

*Primary Examiner*—Philip H. Leung

*Attorney, Agent, or Firm*—Panitch Schwarze Jacobs & Nadel

[57] ABSTRACT

A package includes a food containing shell for storing, displaying, shipping and heating of the enclosed food in a microwave oven. The shell includes a lower portion and an upper portion, and is constructed, at least in part, of a multi-layer laminate which includes a microwave-interactive layer of a metallic alloy of nickel and chromium. The laminate also includes a structural layer and a protective layer on the side of the laminate facing the food. The shell may also include slits which remain closed during storing, displaying and shipping, but which open under the internal pressure of the vapors formed during heating allowing the vapors to be vented from the interior of the shell.

20 Claims, 4 Drawing Sheets

COOK AND SERVE FOOD PACKAGE FOR THE STORING AND HEATING BY MICROWAVE ENERGY OF A FOOD ITEM

FIELD OF THE INVENTION

The present invention relates generally to packaging and, more particularly, to a specialized package for storage and heating of a contained food item within a microwave oven.

BACKGROUND OF THE INVENTION

In many households in the United States, all the adult occupants are employed outside the home, leaving little time for traditional food preparation. Microwave ovens facilitate fast thawing of frozen food and quick cooking or heating of the thawed food. For this and many other reasons microwave ovens have become a staple appliance in many United States households.

Food purveyors have attempted to capitalize on the two-working adult market by providing prepared foods, frozen immediately after manufacture and presented in a package suitable for immediate insertion into, and rapid thawing and heating or cooking within a microwave oven. More or less homogeneous foods such as soups, casseroles and stews are best adapted to the microwave thawing and heating process. By contrast, certain foods such as meats, which require surface browning or charring for palatability and attractiveness, and foods which have been precooked or prepared with a coating such as a batter coating or which incorporate a bread or crumb-like outer layer and which must be hot, relatively dry and crisp when served, generally do not provide a satisfactorily appetizing product when thawed and then heated or heated without thawing in a microwave oven. In fact, these foods, on heating or on thawing and then heating in a microwave oven without special attention offer to the consumer an unacceptable product which provides a soggy, moist grease-soaked appearance and texture. Examples of such unacceptable food products which, in the past, have been thawed and heated and/or heated without thawing in microwave ovens are pizza, fried chicken, fried fish, hamburger patties, toasted cheese sandwiches and steak.

Various strategies have been developed for improving the appearance and texture of these types of microwave-cooked foods. One such strategy was the addition of radiant electrical resistance heating elements to the microwave oven interior to create a hybrid oven. This effective but costly strategy provides the fast cooking characteristics of the microwave oven together with the high oven air temperatures and radiant heating of the food provided by a traditional oven. Though these hybrid ovens are available in the marketplace, they do not occupy the mainstream of domestic usage, in part, because they are expensive to purchase and costly to operate.

A second such strategy resulted in the development of reusable dish-like cooking utensils (browning dishes) which have embedded within or underneath the food-engaging surface, materials such as ferrites or metallic oxides which interact with and convert the microwave energy to heat, thereby causing the utensil to become heated. Employing this type utensil, the food surface in direct contact with the heated surface of the utensil becomes heated and browned while the remaining mass of the food not in direct contact with the utensil is heated directly by the action of the microwaves. This second strategy works best when the food layer to be crisped or browned is primarily on the bottom of the food, i.e., pizza. Meat products, such as steaks or hamburgers, are also heated or cooked satisfactorily by this type of utensil, though meats usually must be manually turned to brown and char all sides. Breaded-all-over products such as fried chicken or fried fish become soggy, even if turned, primarily because of the relatively low oven air temperatures surrounding the food product. Further, the cooking utensil with burned food baked onto its surface, must be manually washed, a task most microwave owners expect to avoid.

To cope with the high cost of the hybrid microwave/radiant oven and to avoid the disadvantages accompanying the use of the reusable microwave utensils, there has been developed, as a third such strategy, specialized disposable packages which enclose a frozen food product at the point of manufacture or preparation and which allow the food product to be preserved, stored, shipped, displayed and sold to the consumer and then stored in the consumer's freezer until needed. Then, the entire package is removed from the consumer's freezer and is placed directly in the microwave oven and is cooked or heated with or without thawing, with a portion of the disposable package itself acting as a crisping element to provide a crisping or browning effect on the surface of the food product. A portion of the package may also serve as a filter or attenuator to reduce the direct microwave energy heating rate of the food product within the package to prevent the food product from becoming overcooked while the crisping or browning process is being conducted.

Unfortunately, packages of this type, though providing some improvement over open heating in a traditional microwave oven, have failed to provide the high level of satisfactory gustatory sensation, which includes the visual, aromatic and tactile, in those food products, such as fish or chicken, which have an external or outer layer of crusty material such as breading or bread over or around a moist food core. In such food products the internal composition is generally relatively high in moisture. The moisture driven off by the microwave heating process tends to pass outwardly and condense on the relatively cooler adjacent crusty material rendering it soggy and unpalatable. Merely venting the package for removal of the vapor generated by microwave heating of the food product does not completely prevent condensation of the vapor in the crusty outer layer. The only way to prevent the vapor from condensing in the crusty or breaded outer layer is to heat the outer layer to about 212° F. before the moisture released from the interior of the food product reaches it. The heating can be done either by direct contact with a hot surface, by radiation from an adjacent hot surface, or by heat transferred to the crusty outer layer on the food surface by heated air surrounding the outer layer. So long as the outer layer is heated above a certain temperature before released water vapor reaches it, condensation of moisture within the crusty outer layer is avoided and a hot, crisp food product, highly acceptable to the consumer, will result.

Some prior art packages have employed ferrite powders which absorb microwave energy and give off heat for coating flexible throw-away packages or wrappings for food products which serve the dual purposes of directly heating the surface of the food product to provide the desired browning or crisping and for warming a layer of air around the food product to prevent condensation of vapor released by the microwave heating of the interior of the food product. Other prior art packages include a polyester sheet on which has been deposited aluminum in a very thin layer, typically only a few angstroms, to serve as the microwave absorbing heating element. Though aluminum is desirable as a microwave interactive heating element material because of its low cost, its use in microwaveable packages is limited because of its high susceptibility to oxidation and corrosion. The effectiveness of aluminum or any metal as a microwave interactive heating material depends on its electrical conductivity. Because aluminum is an excellent conductor of electricity, to achieve the correct electrical resistance for proper heating of the outer layer of a food product the coating of aluminum must be very thin, typically on the order of microns or millionths of an inch. When micron-thin aluminum is exposed to oxidative or corrosive media, such as during extended exposure to certain food products during shipment and storage in a freezer, the products of the resulting corrosion or oxidation are electrical non-conductors which reduce the effectiveness of the affected area of the aluminum to respond by absorbing the microwaves and becoming hot. Such degradation of the aluminum coating leads to spotty, uneven heating of some areas of the food product and scorching and burning of other areas of the food product.

Further, microwave heating itself tends to degrade the effectiveness of the thin aluminum coatings used in such prior art packages. Local overheating and destruction of the heating surface can be caused by high local microwave intensities resulting from standing waves or nodes, especially in lower cost microwave ovens.

The present invention solves the various problems generated by past practices by providing a package which utilizes as a heating element a layer or coating of a corrosion-resistant nickel alloy of relatively high electrical resistivity. The high resistivity of the nickel alloy allows a greater thickness of the alloy material coating to be deposited, preferably on a polyester sheet or other support film, to achieve the correct electrical resistivity needed for the proper microwave interactive heating function. Coupled with the inherent corrosion resistance of the high nickel layer coating, the relatively thicker coating provides more uniform temperature response to microwave excitation and superior thermal stability even at local points of high microwave intensity resulting from standing waves or nodes. Further improvements in the present invention are directed toward the use of corrugated elements to provide increased heating intensity in areas where a higher temperature is required for enhanced crisping or browning.

The present invention also provides slits in a portion of the food package or shell to maintain the air in the package at the desired high temperature and pressure. The slits remain closed during the storage and display periods to protect the food product, but open when a predetermined internal package pressure is attained during heating, thereby allowing restricted venting of vapor released from the food product during heating.

SUMMARY OF THE INVENTION

Briefly stated, the present invention comprises a package for the storing and heating of a food item contained therein. The package includes a shell which has a top and a bottom defining an interior and an exterior. The shell includes a laminated portion which has three layers, a structural layer, generally the outermost layer for providing mechanical integrity, a protective layer for engaging the food item, and a microwave interactive layer. The microwave interactive layer is positioned between the protective layer and the structural layer and includes at least one metallic alloy layer including at least the following components: Nickel between 57% and 90% by weight, chromium between 10 and 20% by weight.

BRIEF DESCRIPTION OF THE DRAWINGS

The foregoing summary, as well as the following detailed description, will be better understood when read in conjunction with the appended drawings. For the purpose of illustrating the invention, there is shown in the drawings embodiments which are presently preferred, it being understood, however, that this invention is not limited to the precise arrangements and instrumentalities shown. In the drawings.

DESCRIPTION OF PREFERRED EMBODIMENTS

All of the materials used for package construction as described herein are heat stable, non-volatile and compatible with microwave heating, as well as approved for use in food packaging.

Figure 1:
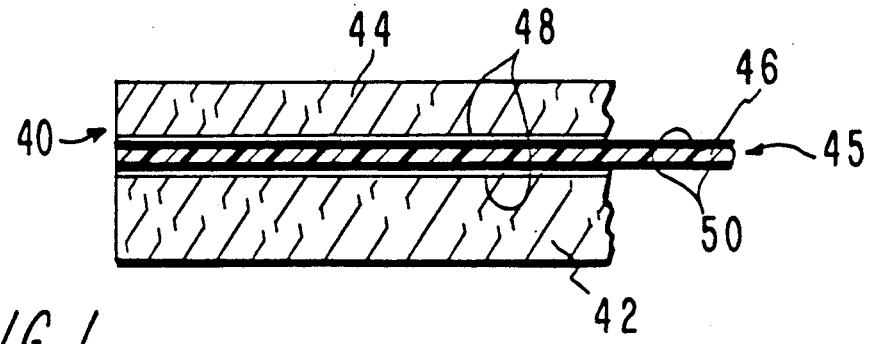
FIG. 1 is a side elevational view in cross section of a laminate portion of a package in accordance with the present invention.

In the drawings; FIG. 1 is a side elevational view of a laminate 40 in accordance with a first embodiment of the present invention and includes a structural layer 42 which in the present embodiment is preferably constructed of paperboard. More particularly, the structural layer 42 is formed of a 12 point paperboard solid bleached sulfite made from virgin pulp, having a thickness of about 0.012 inches. As an alternate, bleached Kraft paper with a weight of 50 pounds per 1000 square feet can be used for the structural layer 42, although it will be appreciated by those skilled in the art that any paper-like sheet material, fibrous, particulate or homogeneous, which meets the structural, thermal, sanitary and health requirements may alternatively be employed. The structural layer 42 is employed to provide structural support for the package in a manner which will hereinafter become apparent.

The laminate 40 also includes a protective layer 44 for engaging a food product or food item (not shown in FIG. 1). In the present embodiment, the protective layer 44 is preferably a grease-proof, release-coated paper preferably having a weight of about 25 pounds per 1000 square feet. Alternatively, a chemical release coating could be employed instead of the coated paper. The protective layer 44 serves to isolate the food item from the remainder of the laminate 40 and to provide a non-stick surface for the food item. It has been found that with some prior art packages the microwave energy absorption element, though uniform in thickness, results in the creation of a thermal gradient within the package, with the outer edges of the package being at a higher temperature than the center of the package. The protective layer 44, whether formed of a release-coated paper or a chemical coating, enhances the microwave heating of the energy absorption element to help eliminate the formation of such a thermal gradient within the package and to thereby provide more uniform heating of a food product within the package. In addition, the thermal conductivity of the protective layer 44 provides improved thermal conductivity to complement and enhance microwave absorption heating to provide proper crisping and/or browning of the food item.

Figure 5:
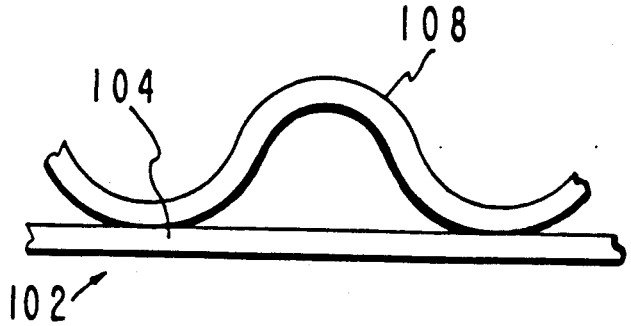
FIG. 5 is a greatly enlarged elevational view of a corrugated laminate subassembly portion of a package in accordance with the present invention.

The laminate 40 further includes a microwave interactive layer 45 sandwiched between the protective layer 44 and the structural layer 42. As best shown in FIG. 5, the microwave interactive layer 45 in the present embodiment is preferably comprised of a sheet of film 46, such as polyester film, which has applied on each major surface or side a metallic alloy layer or coating 50 having a composition which preferably includes 67% nickel, 15.5% chromium and 8% iron by weight. Because the specific electrical resistance of an alloy of this type is much greater than the specific electrical resistance of aluminum, the thickness of the metallic alloy coatings 50 is generally thicker than a typical aluminum coating employed in prior art packages for the same purpose. The use of much thicker metallic alloy coatings provides the heating necessary to properly crisp and/or brown a food item while avoiding the above-discussed problems inherent in utilizing a thin aluminum coating.

The ranges of composition for the metallic alloy coatings 50, which provide satisfactory performance of the microwave interactive layer 45, are nickel 57% to 90%, chromium 10% to 20% and iron 0 to 11%. Within these ranges reside alloys such as Nichrome V (80% nickel, 20% chromium); Chromel (90% nickel, 10% chromium); Inconel (76% nickel, 15% chromium, 9% iron) and Nichrome II (69.35% nickel, 17.95% chromium, 10.53% iron, 1.58% manganese) and Nichrome (61.20% nickel, 24.88% chromium, 12.05% iron and 1.44% manganese). It will be appreciated by those skilled in the art that the foregoing known alloys and/or any other alloys within the specified composition ranges may alternatively be employed as a metallic alloy coating 50.

Figure 4:
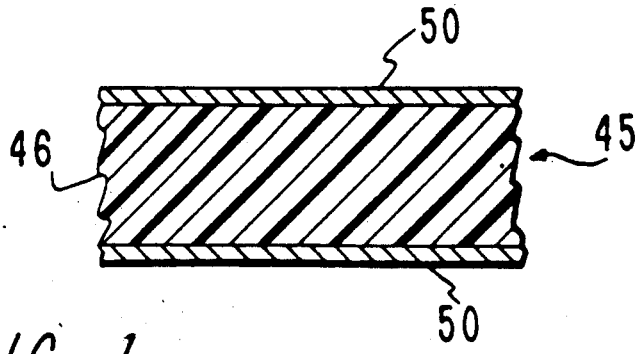
FIG. 4 is a greatly enlarged crosssectional view of the laminate of FIG. 1 illustrating a support layer and two metallic coatings.

In the present embodiment, as illustrated in FIG. 4, the film 46 to which the metallic alloy coatings 50 are applied forms a support layer for the metallic alloy coatings 50. Preferably, the film or support layer 46 is formed of 0.001 inch thick polyester film of a type which is available from a variety of suppliers, including the Du Pont Company. Alternatively, other film materials, such as polyethylene, polytetrafluoroethylene, nylon, polysulphone and cellophane could be employed as the support layer 46 for the metallic coatings 50.

In the present embodiment, as illustrated in FIG. 4, the metallic alloy coatings 50 are preferably applied to both sides or surfaces of the polyester film support layer 46 utilizing a sputtering deposition process of a type known in the art. Alternatively, the metallic alloy coatings 50 could be applied to the polyester film 46 utilizing some other suitable process, such as a vacuum deposition process. The metallic alloy coatings 50 preferably have a thickness of about 100 angstroms (0.0002 inch).

In the present embodiment, the three layers 42, 44 and 45 which form the laminate 40 are bonded together utilizing a known laminating process or technique and preferably employing a high temperature resistant adhesive 48 such as a water based polyvinyl acetate adhesive V-6036 made by the H.B. Fuller Company. It will be appreciated by those skilled in the art that any other high temperature adhesive could alternatively be employed for this purpose.

Figure 2:
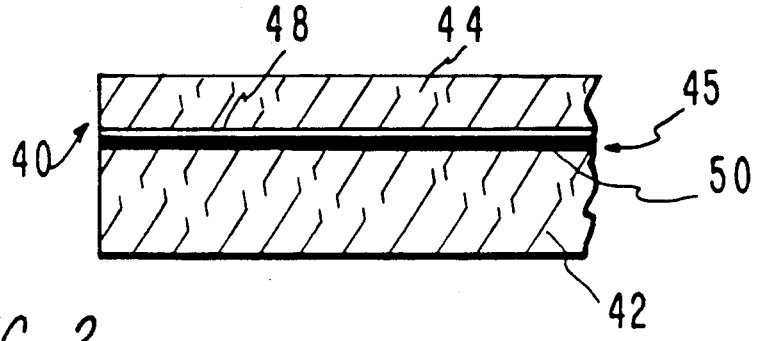
FIG. 2 is a side elevational view in cross section of a second version of the laminate of FIG. 1.

Referring now to FIG. 2, there is shown a second version or embodiment of a laminate 40 in accordance with the present invention. In the embodiment shown in FIG. 2, the laminate 40 comprises a structural layer 42, a protective layer 44 and a microwave interactive layer 45. The structural layer 42 and the protective layer 44 are the same as those corresponding layers employed in the embodiment shown in FIG. 1 and discussed above. The microwave interactive layer 45 is different in that it does not employ a separate film or support layer 46. Instead, a single layer of metallic alloy coating 50 is applied directly to the structural layer 42 utilizing a sputtering deposition process or any other suitable process which provides substantially the same result. The protective layer 44 is secured directly to the metallic alloy coating 50 by an adhesive 48, as described above, or by an equivalent adhesive.

Since the embodiment of FIG. 2 has only a single metallic alloy coating 50, the microwave interactive heating effect within any given laminate area in the presence of microwaves is less than the heat generated in that same area if the microwave interactive layer includes two metallic alloy layers 50 as in the embodiment of FIG. 1.

Figure 3:
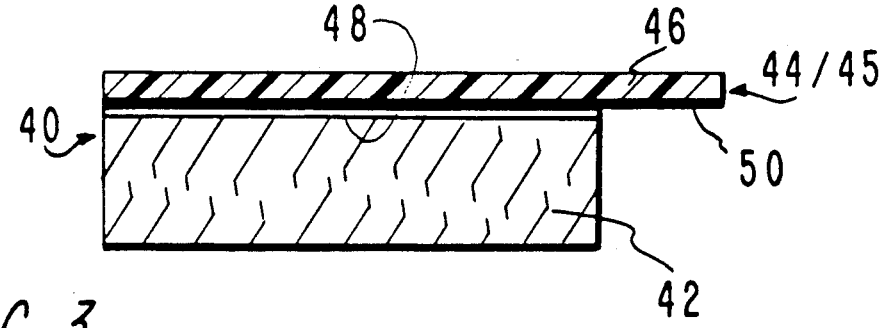
FIG. 3 is a side elevational view in cross section of a third version of the laminate of FIG. 1.

FIG. 3 illustrates a third version or embodiment of a laminate 40 in accordance with the present invention. In the embodiment of FIG. 3, the laminate 40 comprises a structural layer 42 which is the same as discussed above in connection with the embodiment of FIG. 1. However, in the embodiment of FIG. 3, the features of the microwave interactive layer 45 and the protective layer 44 are combined. A single sheet of film or support layer 46 is employed with one surface employed for engagement with a food item (not shown) and the other surface receiving a single metallic alloy layer 50. The metallic alloy layer 50 is applied to the support layer 46 in the manner discussed above and the laminate 40 is formed utilizing an adhesive 48, also of the type described above. Since the exposed surface of the support layer 46 is in direct contact with the food item, a material such as polyester or polytetrafluoroethylene having the above-documented properties of the protective layer 46 is preferred.

FIG. 5 shows a corrugated composite structure 102 which includes a corrugated microwave laminate 108 which preferably has the structure of any of the laminates 40 shown and described in connection with FIGS. 1, 2 or 3. The corrugated laminate 108 is adhesively secured to a generally flat substrate 104 which preferably is comprised of a 0.012 inch thick paperboard backing, preferably constructed of solid bleached sulfite paper.

The corrugations are preferably generally straight and parallel, though circular, annular corrugations may alternatively be employed. The height and/or spacing of the corrugations is determined by the size and/or weight of a food item or food product intended to be placed thereon. The corrugations serve the multiple purposes of increasing the mass of microwave interactive material at or near the interface with the food product, which has the effect of increasing the fraction of microwave energy which is converted to heat at or near the food product interface and further reducing the fraction of microwave energy which is transmitted to heat the food product directly within the zone of the corrugations, of providing hot ridges which scorch the food product to provide a grilled appearance and texture, of providing mechanical stiffening, of insulating the hot cooked food product from the bottom of the package, thereby allowing the food product to retain its hot, as-cooked condition longer during the serving period and of providing channels into which fat, juices and moisture emitted by the cooking food product can flow and reside without bathing the product in such liquid, thereby deteriorating the desired crisp surface of the food product.

FIGS. 7, 8, 9, and 10 are side elevational views in partial cross section of four slightly different constructions of a shell 10, all preferably employing, in whole or part, one form of the laminates 40 of FIGS. 1, 2 or 3 in accordance with the present invention. The shell 10 defines a package for a food item or food product and includes both a top portion or lid 22 and a bottom or lower portion 12 defining a package exterior and an interior for containing the food item. The laminates 40 may be used in the lower portion 12 of the shell 10, as the lid 22 or as a separate corrugated insert 15 (FIG. 2 only) within the interior of the shell 10. Portions of the shell 10 which are not made of any of the laminates 40 are preferably formed of microwave-transparent material such as structural type cardboard, generally also of a grease-resistant material and preferably coated with a release coating at least on the side facing the food item to prevent sticking.

The shell 10 preferably has lower portion 12 which includes a generally flat base 14 with a tapered sidewall 13. The lower shell portion 12 is constructed of any one of the laminates 40 or their variations described in connection with FIGS. 1–3 or their equivalents. The sidewall 13 is also preferably formed of any one of the laminates 40. or their variations. Preferably, the sidewall 13 is also fluted or corrugated with the corrugations extending generally vertically. By providing a sidewall 13 with flutes or corrugations, additional microwave reflective surfaces are provided to reflect microwave energy back into the interior of the shell 10. The sidewall 13, though shown in a generally outwardly tapered configuration, could be generally vertical or could extend at any other angle with respect to the base 14. An interior space 26 is defined by the periphery of the shell 10 within which a food product or food item 20 (FIGS. 7 and 8) is positioned during the course of manufacture for shipment, storage, display, sale and eventual cooking by a consumer.

The upper end of the sidewall 13 incorporates a generally flat upper shelf or lip 24 on which the lid 22 resides. Preferably, the shelf 24 terminates at its outer periphery in an upturned, generally cylindrical flange portion or rim 25, which is intended to be folded inwardly on top of the lid 22 for mechanically holding the lid 22 in place during shipping, storage, display and eventual cooking by the consumer within the microwave oven.

Figure 7:
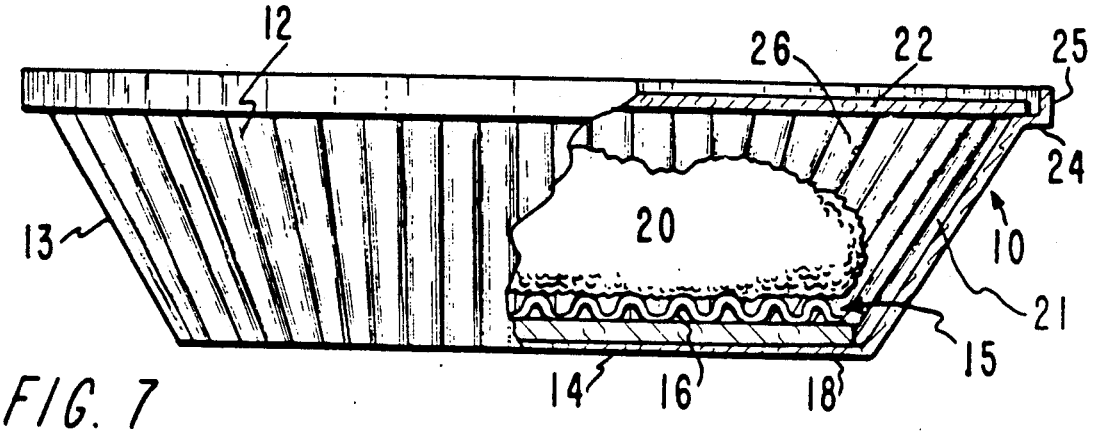
FIGS. 7, 8, 9, and 10 are side elevational views in partial cross section of packages in accordance with the present invention showing various shell constructions.

The lid 22 is shown in FIG. 7 as being fabricated of a microwave-transparent material, described above, to allow full access, without attenuation, of microwaves from a microwave oven to the top or upper surface of food product 20 for direct microwave heating. In another construction (not shown) the lid 22 may be formed of any of the laminates 40 to at least partially shield the food item 20 from direct heating by the microwaves, to provide a higher air temperature in the upper portion of the interior 26 of the shell 10 and to provide radiated heat for crisping of the top or upper surface of the food product 20.

Figure 6:
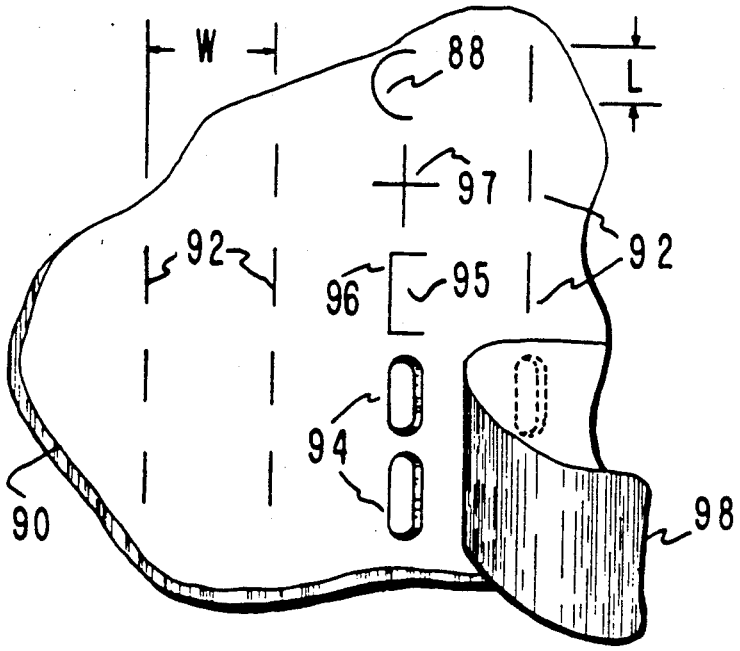
FIG. 6 is a top plan view of a portion of a slitted top portion of a package in accordance with the present invention.

The lid 22, whether fabricated of one of the laminates 40 or of microwave-transparent material, may be formed with slits or slots for venting means as described above in connection with FIG. 6. FIG. 6 shows a section of the upper portion of a shell 10 which could be any of the laminates 40 described in connection with FIGS. 1, 2 or 3 formed with a plurality of slits 92. The slits 92 are spaced apart, preferably in generally parallel rows with one-half inch spacing between the rows, with each slit 92 within a row having a length of about 3/16 inch and with the ends of each slit 92 being spaced about 3/16 inch from the end of adjacent slits. The slits 92 need not be in rows as shown and other spacings both between the slit rows and between the slits within a row, as well as other slit lengths, could be selected as required. The slits 92 function to vent the interior of a package in order to remove excess vapor and to maintain a predetermined maximum pressure and/or temperature within the shell 10. The slits 92 initially remain closed to protect and preserve the food product prior to heating or cooking and open only upon attaining a predetermined pressure level within the shell 10.

Where venting of the package must be achieved to provide lower interior shell pressures than possible utilizing single straight slits 92, one or more pairs of intersecting slits 97 may be provided in the form of either a T or an X. If still lower venting pressures are required, one or more groups of three intersecting slits forming a generally U-shaped slit 96 may be provided. The reduced pressure venting is possible because the tab 95 positioned within the U-shaped slit 96 is more easily displaced into an open position than are the sides of the straight slits 92. The length of the sides of the U-shaped slit 96 can be varied to control the pressure within the shell 10 at which venting begins. An alternate U-shaped slit 88 is shown where the shape of the slit is a portion of an arc.

Where venting must be accomplished with least initial restriction, the slits can be open or enlarged to form slots, for example to a flat-sided oval shaped slot 94. When open slots are employed, sealing of the interior of the shell 10 for shipping, storage and display may be achieved with a gummed label or other such cover member 98 which covers the open slots 94 during storage and shipment and is removed by the consumer prior to cooking.

In the embodiment shown in FIG. 7, the bottom of the lower portion 12 of the shell 10 contains a separate corrugated subassembly insert or heating pad 15 which is formed of a corrugated laminate as described above in connection with FIG. 5. In an alternate construction, the base 14 of the shell 10 is constructed of microwave-transparent material rather than one of the laminates 40, and a corrugated subassembly pad 15 is inserted within the bottom portion of the shell 10 beneath the food item 20 to provide the desired crisping and/or browning.

Figure 8:
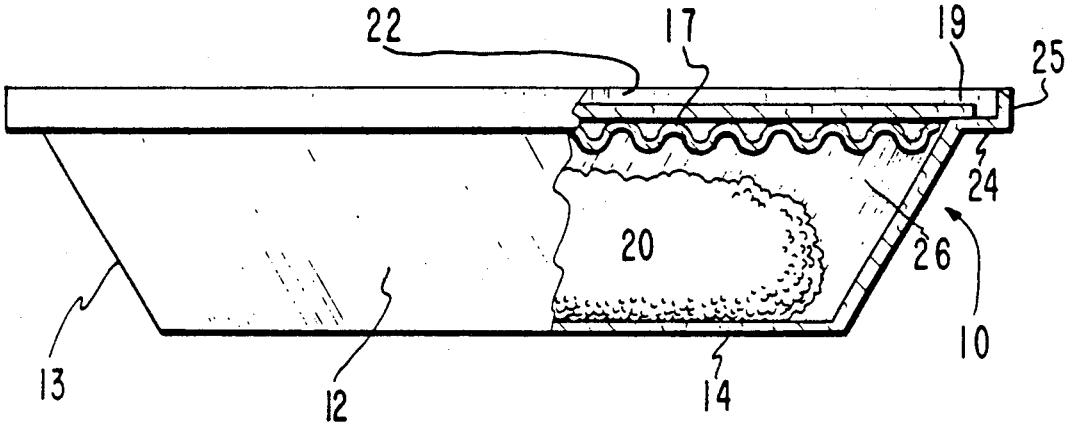

FIG. 8 shows a shell 10 with an interior space 26 and a food product 20 on the base 14 of the lower portion of shell 10. The lid 22, however, is fabricated of a corrugated laminate 17 formed of one of the laminates 40 as described above. Preferably, the substrate portion of the corrugated lid is formed of a microwave-transparent material. A peripheral portion 19 of the lid 22 is left uncorrugated to provide a smooth portion for sealing to shelf 24 when cylindrical portion 25 is folded over the edge 19 of the lid 22. In an alternate construction, lid 22 is formed of corrugations made of one the laminates 40 and includes a substrate which is also formed of one of the laminates 40. Such an alternate construction is employed where a higher crisping effect and greater microwave attenuation is required in the upper portion of the shell.

Figure 9:
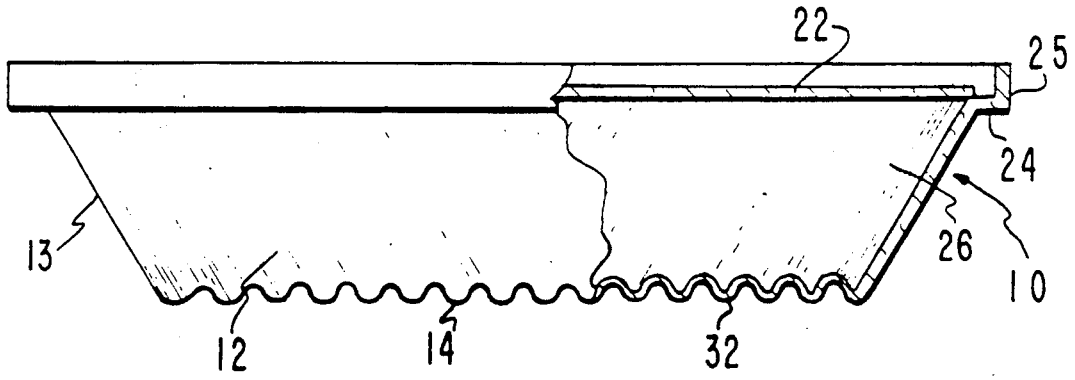

FIG. 9 shows a shell 10 having a base 14 which is fabricated of one of the laminates 40 and includes a corrugated bottom 32 in which the corrugations may be either parallel or annular. This construction is particularly effective for crisping and heating pizza, with its bread lower crust best heated by the direct heat of the corrugated base 14 and its moist and oily upper layer best heated by the direct action of the microwaves through the microwave-transparent lid 22.

Figure 10:
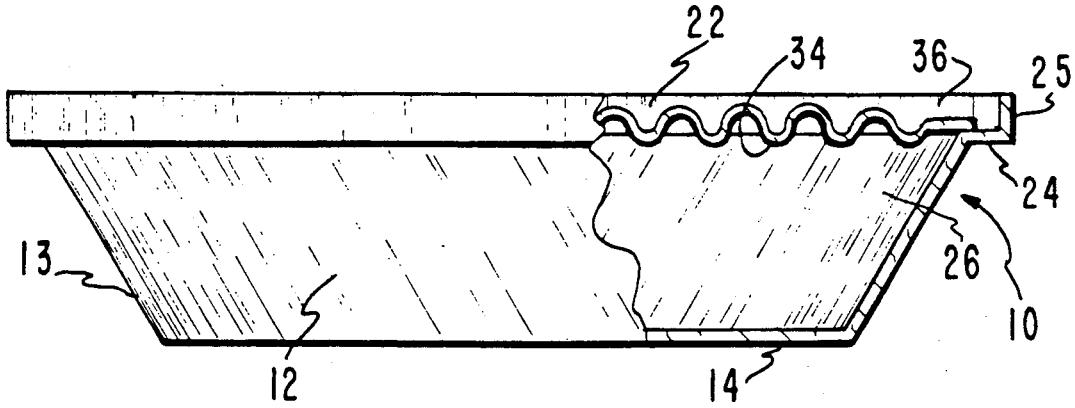

FIG. 10 shows a shell 10 having a base 14 fabricated of one of the laminates 40 and a lid 22 formed of a corrugated laminate 34 which does not include a flat substrate. The lid 22 includes a peripheral portion 36 which is flat to lay securely on shelf 24 to facilitate sealing to the shelf 24 when the uprising rim 25 is folded inwardly and pressed onto edge 36.

Figure 11:
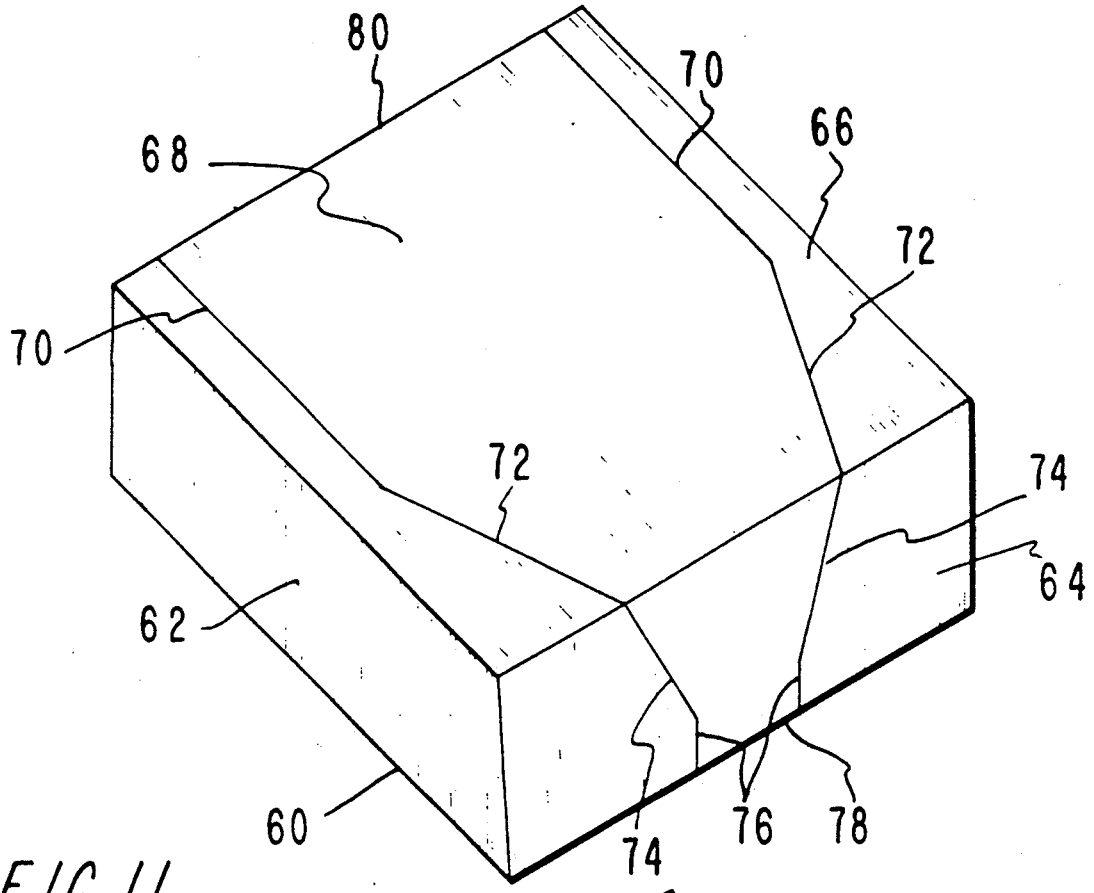
FIG. 11 is a perspective view of an external portion of a package in accordance with the present invention showing scores to facilitate easy opening.
Figure 12:
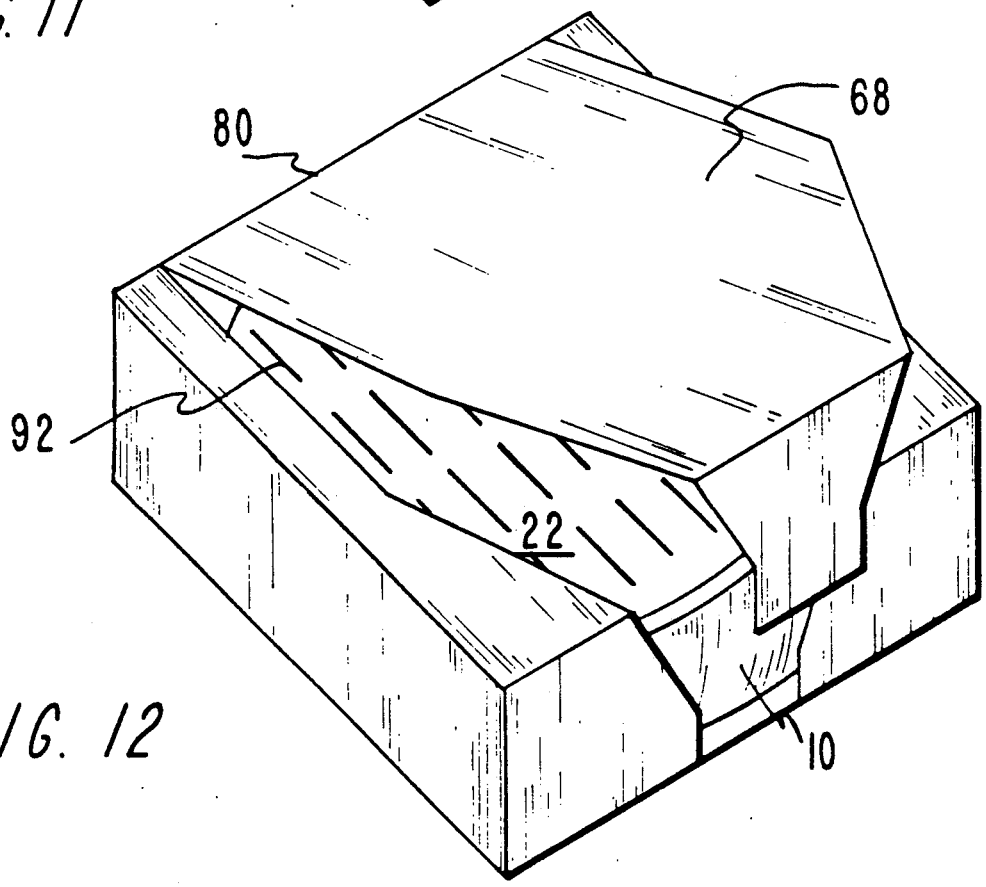
FIG. 12 is a perspective view of the external portion of the package of FIG. 11 showing the scored portion of the package partly removed.

FIG. 11 shows an outer wrapping or carton 60, preferably of a standard size and shape for storage and display and preferably made of cardboard or paperboard. The carton includes a scored top surface 66 and a scored front surface 64. The score lines 70, 80 and 72 of the top surface 66 connect to and continue as score lines 74, 76 and 78 in the front surface 64 to define an irregularly shaped flap 68. Within the carton 60 is placed any of the shells 10 of FIGS. 7, 8, 9, or 10 for shipping, display and storage. When the consumer desires to heat or cook a food product in a shell 10 contained within the carton 60, the front and top are torn along the scores 78, 74, 76, 72, 70 and 80 to release the flap 68. The flap 68 is then removed from the remainder of the carton 60 allowing access to the shell 10. FIG. 12 shows the carton 60 with the score lines torn and the removable flap 68 partly removed showing within the carton the shell 10 with the slits 92 in the venting lid 22. Since the material of the carton 60 is microwave-transparent, preferably cardboard, the carton 60 remains cool during cooking or heating and it can be safely handled with the hot shell 10 within, after completion of the microwave cooking process.

From the foregoing description, it can be seen the present invention comprises a package for storage and microwave heating of food contained therein. It will be recognized by those skilled in the art that changes may be made to the above described embodiments of the invention without departing from the broad inventive concepts thereof. It is understood, therefore, that this invention is not limited to the particular embodiments disclosed but intended to cover the modifications which are within the scope and spirit of the invention as defined by the following claims.

We claim:

1. A package for the storing and heating of a food item contained therein, the package including a top and a bottom defining an interior for containing a food item and an exterior, the package comprising:

a shell including a laminated portion formed of a structural layer, a protective layer for engaging the food item, and a microwave interactive layer, the microwave interactive layer being interposed between the protective layer and the structural layer and including a support layer having an interior facing side and exterior facing side, said support layer being formed of a material selected from the group consisting of polyester, polyethylene, polytetrafluoroethylene, nylon, polysulphone and cellophane, said support layer including a first metallic alloy layer deposited on the interior facing side and a second metallic alloy layer deposited on the exterior facing side, said metallic alloy layers having the following components by weight:

Nickel 67%
Chromium 15.5%
Iron 8%.

2. A package as recited in claim 1 wherein the structural layer is paper.

3. A package as recited in claim 2 wherein the paper is solid bleached sulfite type.

4. A package as recited in claim 1 wherein the metallic alloy layers are deposited on the support layer utilizing a vacuum vapor process.

5. A package as recited in claim 1 wherein the protective layer comprises a grease resistant release coating for engaging the food item.

6. A package as recited in claim 5 wherein the grease resistant release coating is applied to the microwave-interactive layer.

7. A package as recited in claim 1 wherein the protective layer is grease resistant paper bearing a release coating.

8. A package as recited in claim 1 further including a corrugated portion formed of a laminate of substantially the same materials used to form the laminated portion of the shell, the corrugated portion having corrugations facing the interior of the shell.

9. A package as recited in claim 8 wherein the corrugated portion is separate from the shell.

10. A package as recited in claim 8 wherein the corrugated portion is integral with the shell.

11. A package as recited in claim 10 wherein the corrugated portion forms the top of the shell.

12. A package as recited in claim 8 wherein the corrugated portion is separate from but fastened to the shell.

13. A package as recited in claim 1 further including venting means for allowing vapors generated in the shell interior during heating flow to the shell exterior.

14. A package as recited in claim 13 wherein the venting means are generally closed but are actuated to open by pressure generated in the shell interior during heating.

15. A package as recited in claim 14 wherein the venting means comprises an array of slits in the shell.

16. A package as recited in claim 15 wherein the slits are in the top of the shell.

17. A package as recited in claim 15 wherein each slit has the form of a single, generally straight line.

18. A package as recited in claim 15 wherein each slit is formed from two intersecting generally straight lines.

19. A package as recited in claim 15 wherein each slit is formed from three generally intersecting straight lines joined to form a U-shape.

20. A package as recited in claim 15 wherein each slit comprises a portion of an arc.

* * * * *